US009716320B2

(12) United States Patent
Ley et al.

(10) Patent No.: US 9,716,320 B2
(45) Date of Patent: Jul. 25, 2017

(54) PATCH ANTENNA-BASED WIDEBAND ANTENNA SYSTEM

(71) Applicant: Cambium Networks Limited, Ashburton, Devon (GB)

(72) Inventors: John Francis Ley, Oregon, IL (US); Carsten Claus Gruettner, Barrington, IL (US)

(73) Assignee: CAMBIUM NETWORKS LIMITED, Ashburton, Devon (GB)

( * ) Notice: Subject to any disclaimer, the term of this patent is extended or adjusted under 35 U.S.C. 154(b) by 137 days.

(21) Appl. No.: 14/512,139

(22) Filed: Oct. 10, 2014

(65) Prior Publication Data

US 2016/0104943 A1 Apr. 14, 2016

(51) Int. Cl.

| | |
|---|---|
| ***H01Q 13/00*** | (2006.01) |
| ***H01Q 19/19*** | (2006.01) |
| ***H01Q 19/06*** | (2006.01) |
| ***H01Q 1/12*** | (2006.01) |
| ***H01Q 9/04*** | (2006.01) |
| ***H01Q 5/35*** | (2015.01) |

(52) U.S. Cl.

CPC ..... *H01Q 19/191* (2013.01); *H01Q 1/1207* (2013.01); *H01Q 5/35* (2015.01); *H01Q 9/045* (2013.01); *H01Q 19/062* (2013.01); *H01Q 19/19* (2013.01)

(58) Field of Classification Search

USPC ..... 343/755, 700 MS, 702, 753, 781 P

See application file for complete search history.

(56) References Cited

U.S. PATENT DOCUMENTS

2004/0104852 A1* 6/2004 Choi ..... H01Q 1/40 343/700 MS
2011/0068988 A1* 3/2011 Monte ..... H01Q 3/18 343/761

(Continued)

FOREIGN PATENT DOCUMENTS

DE 10 2012 025123 A1 6/2014
WO WO 2007/039289 A1 4/2007

(Continued)

OTHER PUBLICATIONS

International Search Report and the Written Opinion from corresponding international application No. PCT/GB2015/052946, 6pp., Jan. 27, 2016.

*Primary Examiner* — Hoang Nguyen
*Assistant Examiner* — Hai Tran
(74) *Attorney, Agent, or Firm* — Brinks Gilson & Lione

(57) ABSTRACT

Devices describe herein are configured to radiate radio frequency (RF) energy corresponding to RF signals from a first range of frequencies. The device comprises a patch antenna assembly comprising a microstrip disposed on a printed circuit board and a patch antenna. The device also includes a transmitter configured to generate RF signals from the first range of frequencies at an output of the transmitter and a center feed assembly comprising a waveguide, a lens and the patch antenna assembly disposed in the waveguide. The center feed assembly is configured to radiate from the lens radio frequency (RF) energy corresponding to RF signals from first range of frequencies at a power level greater than the first power level.

5 Claims, 13 Drawing Sheets

(56) References Cited

U.S. PATENT DOCUMENTS

| | | | | |
|---|---|---|---|---|
| 2011/0309899 | A1* | 12/2011 | Leiba | H01P 3/121 333/208 |
| 2011/0309987 | A1* | 12/2011 | Haluba | H01Q 1/42 343/755 |
| 2012/0154585 | A1* | 6/2012 | Miranda | B64G 1/1021 348/144 |
| 2012/0287008 | A1* | 11/2012 | Kim | H01Q 1/48 343/841 |
| 2012/0287088 | A1* | 11/2012 | Queck | G06F 3/03545 345/179 |
| 2015/0303566 | A1 | 10/2015 | Nowack | |

FOREIGN PATENT DOCUMENTS

| | | | |
|---|---|---|---|
| WO | WO 2013/190442 | A1 | 12/2013 |
| WO | WO 2014/064462 | A1 | 5/2014 |

* cited by examiner

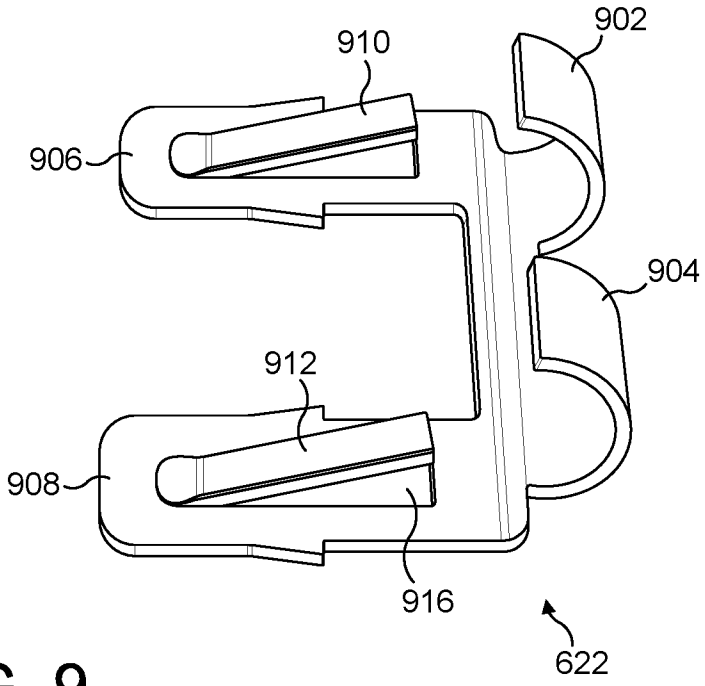
FIG. 9
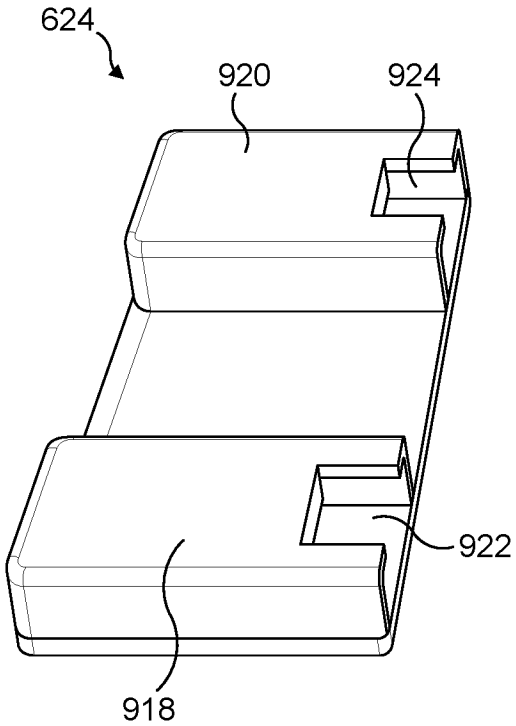

PATCH ANTENNA-BASED WIDEBAND ANTENNA SYSTEM

TECHNICAL FIELD

This application relates generally to wireless communication systems. More specifically, this application relates to apparatus adapted to increase the frequency response and gain of a patch antenna.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The low cost of wireless chipsets has allowed the development of low cost wireless communication devices. Such communication devices have been deployed by wireless internet service providers (WISP) to provide consumers located in remote, underserved areas access to the internet. It is desirable to improve the efficiency and range of such wireless devices to increase the coverage area in part to reduce the cost per subscriber.

SUMMARY

In order to address the need to improve the operational efficiency of low-cost wireless communication devices, apparatus are disclosed herein for improving the frequency response of antenna systems that may be used with low-cost wireless communication devices.

According to one aspect, a device configured to radiate radio frequency (RF) energy corresponding to RF signals from a first range of frequencies is disclosed. The device includes a patch antenna assembly, a transceiver and a center feed assembly. The patch antenna assembly includes a microstrip disposed on a printed circuit board and a patch antenna. The microstrip is electrically coupled with an input of the patch antenna. The patch antenna is configured to radiate RF energy corresponding to RF signals from the first range of frequencies at a first power level and RF signals from a second range of frequencies at a second power level. The second power level greater than the first power level. The transmitter configured to generate RF signals from the first range of frequencies at an output of the transmitter. The output of the transmitter is electrically coupled with the microstrip. The center feed assembly comprises a waveguide, a lens and the patch antenna assembly disposed in the waveguide. The center feed assembly is configured to radiate from the lens radio frequency (RF) energy corresponding to RF signals from first range of frequencies at a power level greater than the first power level.

Other features and advantages will become apparent upon review of the following drawings, detailed description and claims. Additionally, other embodiments are disclosed, and each of the embodiments can be used alone or together in combination. Exemplary embodiments will now be described with reference to the attached drawings.

BRIEF DESCRIPTION OF THE DRAWINGS

FIG. 9 illustrates an exemplary retainer clip and a retainer clip cover that may be used in an exemplary antenna system.

DETAILED DESCRIPTION

Figure 1:
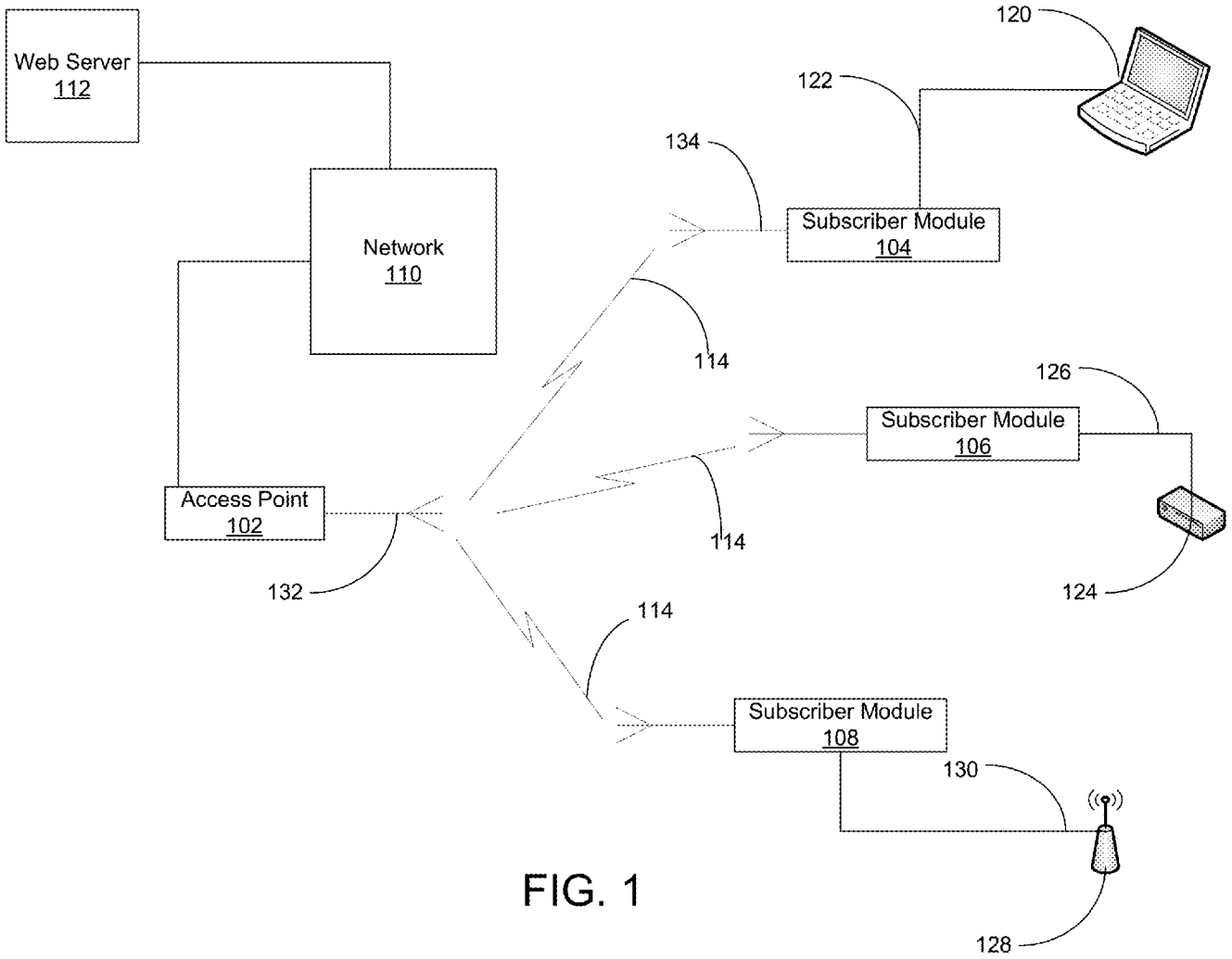
FIG. 1 illustrates an exemplary wireless communication system that may include embodiments of exemplary antenna systems.

Devices and systems described herein improve wireless communication between devices of a communication system such as exemplary communication system 100 of FIG. 1. In particular, such devices and systems improve the radiation and reception of radio frequency (RF) signals by an antenna of a wireless communication device. Generally, the antenna converts received energy impinging on the antenna into electrical RF signals and electrical RF signals to energy which is then radiated or transmitted from the antenna. Devices described herein may improve the bandwidth of an antenna.

By way of example and without limitation, communication system 100 includes an access point (AP) 102 and several subscriber modules (SMs) 104-108. In one embodiment, access point 102 is configured to establish a communication channel to the network 110 via wired connection 112. The access point 102 may transmit and receive data to and from other devices connected to the network 110 via the communication channel. Web server 112 is an exemplary device connected to network 110 that may transmit data to and receive data from access point 102 via the communication channel. The communication channel may operate in accordance with a communication protocol such as Institute of Electrical and Electronics Engineers standard (IEEE) 802.3, IEEE 802.5, and fiber distributed data interface (FDDI) with network 110 via the wired connection 112. The transmission and reception of data may take place in accordance with a networking protocol such as transmission control protocol/internet protocol (TCP/IP). The access point 102 is also configured to establish a wireless communication channel 114 with SMs 104-108. The wireless communication channel 114 may operate in accordance with a wireless communication protocol. IEEE 802.11n is an exemplary wireless communication protocol suitable for use with the communication system 100.

SMs 104-108 are also similarly configured to establish respective wired and wireless communication channels. In an embodiment, SM 104 is configured to establish a communication channel with a user device such as computer 120 via a wired connection 122. In this embodiment, SM 106 is configured to establish a communication channel with a switch 124 via a wired connection 126. SM 108 is configured to establish a communication channel with a wireless router 128 via a wired connection 130.

AP 102 and SM 104 for example, operate as switches that communicatively couple a device connected to the wired connection of an SM, computer 120 for example, to the network 110 via a wireless communication channel 114, for example, established between AP 102 and SM 104. This enables computer 120 to be in data communication with web server 112, for example.

Access point 102 may include circuitry that decodes data received from network 110 and encodes and formats the received data into RF signals representative of the data. For example, the received data may be used to modulate a carrier wave with the modulated carrier wave being applied to the antenna 132. Antenna 132 may cause the transmission of energy representative of the RF signals via communication channel 114 at a predetermined power level. The antenna 134 of SM 104, for example, may receive the transmitted energy and convert the energy into RF signals representative of the data. Circuitry in SM 104 may then demodulate and decode the RF signals into the data that was received by AP 102 from network 110. The decoded data may then be transmitted to computer 120 via the wired connection 122.

Similarly, SM 104 may include circuitry that decodes data received from computer 120 and encodes and formats the received data received into RF signals representative of the data. Antenna 134 may cause the radiation of energy representative of the RF signals via communication channel 114 at a predetermined power level. The antenna 132 of AP 102, for example, may receive the radiated energy and convert the energy into RF signals representative of the data. Circuitry in AP 102 may then decode the RF signal into the data that was received by SM 104 from computer 120. AP 102 may analyze the data to identify the destination for the data. AP 102 may forward the data to the appropriate device on network 110, web server 112 for example.

The RF signals generated by access point 102, for example, may have a range of frequencies. Typically, the difference between the minimum and maximum frequency of the range corresponds to the bandwidth of the wireless communication channel. Typically, the frequency range of the RF signals, their power levels and the encoding of the data into the RF signals are defined by the wireless communication protocol.

Antenna gain, efficiency and bandwidth are exemplary operational parameters of an antenna, antenna 132 for example. Bandwidth describes the range of frequencies over which the antenna 132 can properly radiate or receive energy. The efficiency of an antenna relates the power delivered to the antenna 132 by AP 102 and the power radiated or dissipated within the antenna 132. Antenna gain describes how much power is transmitted in the direction of peak radiation. In a preferred embodiment, antenna 132 may correspond to a patch antenna. A patch antenna (also known as a rectangular microstrip antenna) is a type of radio antenna with a low profile, which can be mounted on a flat surface. It may consist of a flat rectangular sheet or "patch" of metal, mounted over a larger sheet of metal called a ground plane. The patch of metal may correspond to the radiating surface. In an embodiment, the ground plane may be deposited on a printed circuit board. In an embodiment, devices described herein may improve the gain, efficiency and the bandwidth of a patch antenna.

Figure 2:
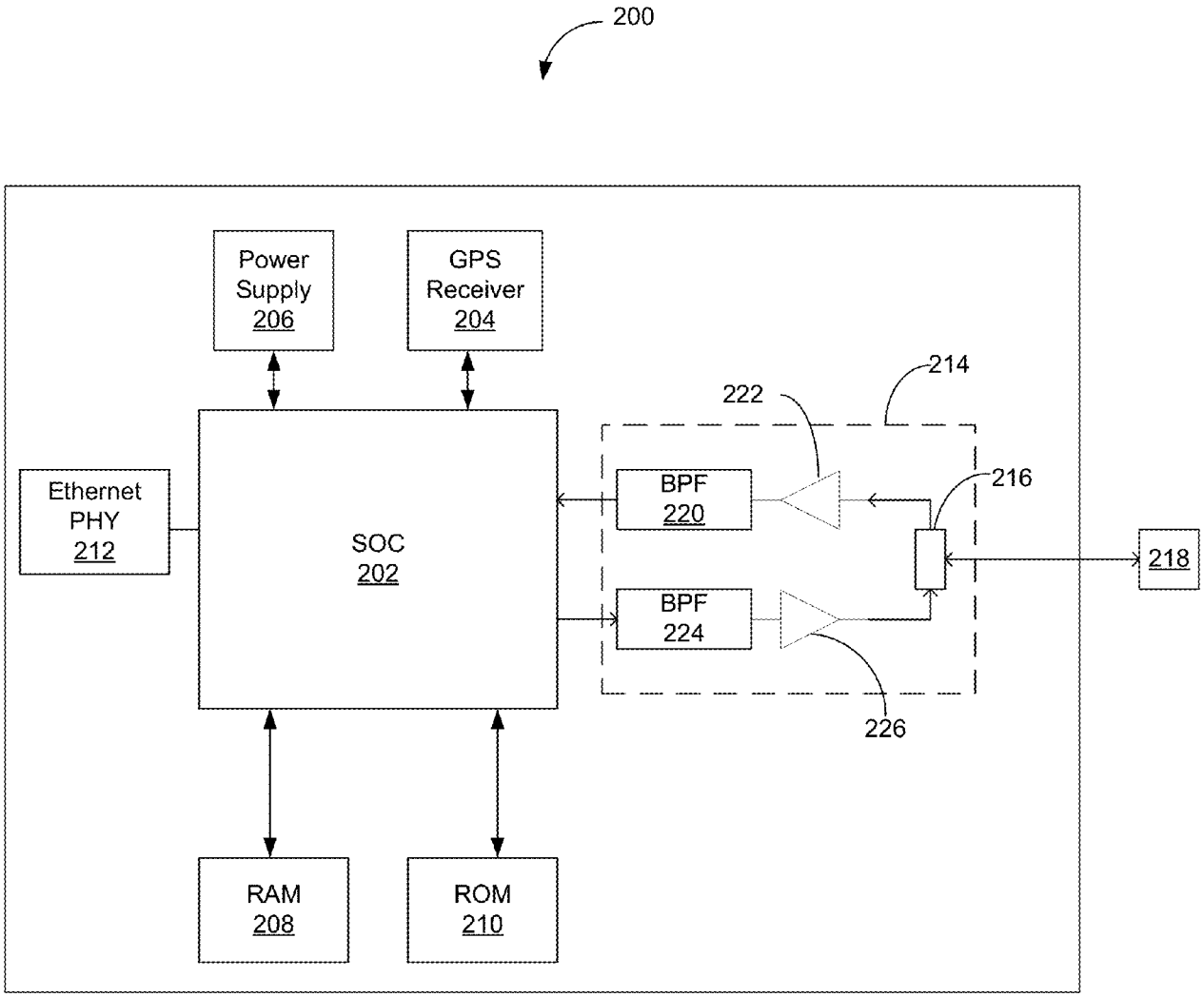
FIG. 2 is a block diagram of an exemplary communication device that may be connected to an embodiment of an exemplary antenna system.

FIG. 2 is block diagram of an exemplary device 200 that may include structures that improve any one or all of the gain, efficiency and bandwidth of an antenna system. In an embodiment, wireless device 200 may correspond to the AP 102 of FIG. 1.

In an embodiment, device 200 comprises a system on a chip (SOC) 202, global positioning system (GPS) receiver 204, power supply 206, random access memory (RAM) 208, read only memory (ROM) 210, Ethernet physical layer (PHY) 212, transceiver 214, impedance network 216 and antenna system 218. In other embodiments, the device 200 may include additional, different or fewer components relative to those shown in FIG. 2. The illustrated embodiment is intended to be exemplary only.

In an embodiment, system on a chip (SOC) 202 is configured to operate device 200. In this embodiment, SOC 202 may receive data from network processor 110 (FIG. 1) and may format the received data in accordance with the wireless protocol and generate RF signals that encode the data. Data may be encoded by the phase and amplitude, for example, of the generated RF signals. In an exemplary embodiment, SOC 202 may implement a suitable modulation scheme to encode the data. The Qualcomm Atheros 802.11n Wi-Fi® AR9350 is an exemplary SOC that generates RF signals in accordance with 802.11 wireless communication protocols.

In an exemplary embodiment, read only memory (ROM) 210 may be adapted to store software instructions that when executed by processor 202 cause device 200 to receive and transmit data from and to network 110 and wireless communication channel 114. Random access memory (RAM) 208 stores data and software instructions for access by other components such as the SOC 202.

Global positioning system (GPS) receiver 204 is configured to receive GPS signals transmitted by GPS satellite and generate location information for device 200 based on information contained in the received GPS signals. Ethernet PHY 212 is configured to receive IEEE 802.3 protocol-conforming electrical signals representative of data from network 110 and convert the electrical signals to digital representations of the data. Ethernet PHY 212 is also configured to receive digital data from SOC 202 and convert the received digital data to IEEE 802.3-compliant electrical signals that may be transmitted to network 110. In an exemplary embodiment, Ethernet PHY 212 may be electrically coupled to an RJ45 connector.

Power supply 206 is configured to generate the various supply voltages required for the operation of device 200. In an embodiment, power supply 206 may include a transformer, a rectifier, a filter and a regulator, for example. In this embodiment, power supply 202 is adapted to receive an AC voltage, 120 V, 60 Hz for example, and convert the AC voltage to one or more DC voltages, 5V and 3.3V for example. In another embodiment, power supply 206 may receive a DC voltage at one voltage level, 24 V for example, and convert the DC voltage to one or more other DC voltages, 5V and 3.3V for example. In a preferred embodiment, a DC voltage may be received via the RJ45 connector. One skilled in the art will recognize this as a power over Ethernet (POE) configuration.

Transceiver 214 comprises a receiver chain, a transmitter chain and a transmit/receive switch 216. The receiver chain comprises band pass filter (BPF) 220 and low noise amplifier (LNA) 222. The transmitter chain comprises a band pass filter 224 and power amplifier 226.

Switch 216 connects one of the receiver chain or transmitter chain to the impedance network 218. In an exemplary embodiment, transceiver 214 is operated in half duplex mode. In this mode of operation, while device 200 is receiving RF signals (listening) via wireless communication channel 214, device 200 does not transmit. Similarly, while device 200 is transmitting RF signals (talking) via wireless communication channel 214, device 200 cannot transmit data.

In an embodiment, SOC 202 controls the half-duplex operation by controlling the operation of switch 216. For example, to receive RF data from the wireless communication channel 114, SOC 202 operates switch 216 such that an output of antenna system 218 is electrically connected to an input of the SOC 202 via LNA 222 and BPF 220. As previously discussed, antenna system 228 may convert received energy into RF signals. LNA 222 may amplify the received RF signals. BFP 220 may filter RF signals with frequencies that are outside the desired range of frequencies. SOC 202 may then demodulate and decode the filtered RF signals to recover the data.

To cause the transmission of data, SOC 202 may operate the switch 216 to create an electrical path between an output of the SOC 202 and antenna system 218 via BPF 224, power amplifier 226. SOC 202 may generate RF signals corresponding to data to be communicated via wireless communication channel 214. BPF 224 may filter the RF signals to remove RF signals of undesirable frequencies. Power amplifier 226 may amplify the filtered RF signals and antenna system 218 may radiate the amplified RF signals as energy.

In an exemplary embodiment, device 200 may be configured to synthesize RF signals with frequencies that range from 5.2 Gigahertz (GHz) to 5.9 GHz or any subset thereof. The synthesized RF signals encode data to be transmitted via a wireless communication channel. In a preferred embodiment, antenna system 228 may include a patch antenna. The patch antenna may independently be adapted to receive and radiate energy from RF signals with frequencies that range from 5.7 GHz to 5.9 GHz. Separately, the patch antenna may provide a gain of 8 dBi for RF signals with frequencies within the 5.7 GHz to 5.9 GHz range. A suitable patch antenna is disclosed in United States Patent Publication 2014/0035786, which is herein incorporated by reference in its entireties.

Figures 3A, 3B:
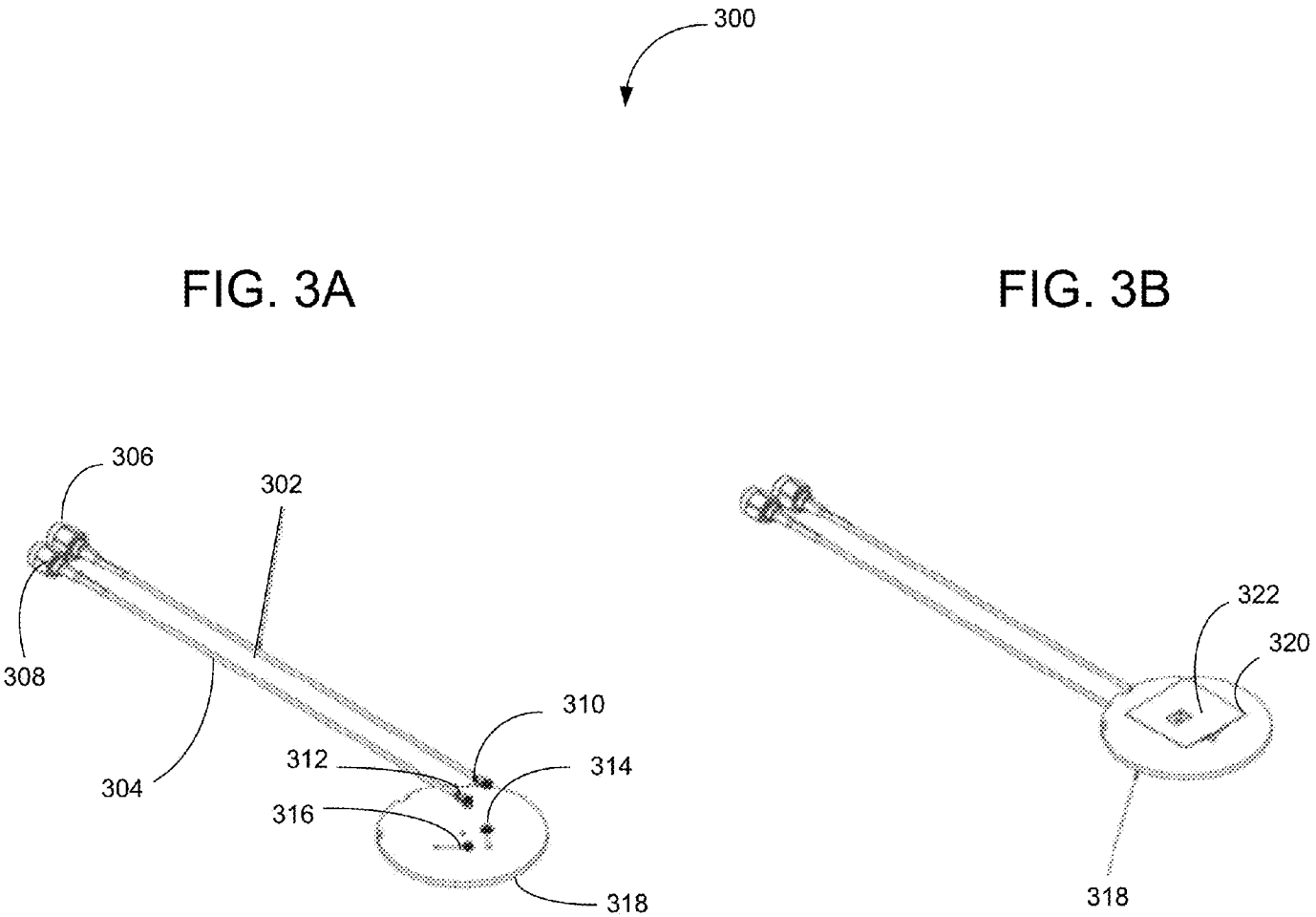
FIG. 3A illustrates an exemplary structure that may be adapted with an exemplary patch antenna.
FIG. 3B illustrates an exemplary patch antenna structure suitable for connecting to a wireless communication device.

FIGS. 3A and 3B illustrate a preferred embodiment of differential patch antenna assembly 300 for use in the antenna system 218. In this embodiment, transceiver 214 of FIG. 2 is configured to transmit and receive differential-mode RF signals to and from antenna system 218, respectively. Differential mode signaling is a method of transmitting a signal electrically with two complementary signals sent on two paired wires. A suitable single-mode patch antenna assembly is also contemplated to realize the advantages of disclosed antenna systems disclosed herein.

The differential patch antenna assembly 300 comprises two electrically conductive cables 302 and 304. The ends 306 and 308 of conductive cables 302 and 304 respectively may be adapted with connectors suitable for mechanically and electrically mating with receptive connectors provided on device 200 (FIG. 2). The receptive connectors may be electrically connected to the common terminal of switch 216. The ends 310 and 312 of conductive cables 302 and 304 respectively may be connected to microstrips 314 and 316 disposed on printed circuit board 318. A microstrip is a type of electrical transmission line which can be fabricated using printed circuit board technology, and is used to convey frequency signals. It consists of a conducting strip separated from a ground plane by a dielectric layer known as the substrate. The microstrip operates as an impedance matching device. In an embodiment, the microstrip provides a means for improving power transfer from the receptive connectors to the patch antenna terminals over the desired frequency range of the antenna system which otherwise would be restricted by the frequency range of the patch antenna alone. Other methods of impedance matching and improving power transfer over the desired frequency range are contemplated.

In a preferred embodiment, microstrips 314 and 316 in conjunction with below described elements of the antenna system 218 may allow for the radiation and reception of energy from RF signals which range in frequencies from 5.2 Gigahertz (GHz) to 5.9 GHz. Separately, the below described elements of the antenna system 218 may provide a gain of between 20 and 28 dBi for RF signals which range in frequencies from 5.2 Gigahertz (GHz) to 5.9 GHz.

Two tabs (not shown) of a metal plate 320 may be connected to microstrips 314 and 316. Metal plate 320 constitutes the radiating surface of differential patch antenna assembly 300. RF signals generated by device 200 may be coupled to the metal plate 320 via conductive cables 302 and 304. Excitation of the metal plate 320 by the RF signals causes the differential patch antenna assembly 300 to radiate energy from the radiating surface 322 of metal plate 320.

Figure 3C:
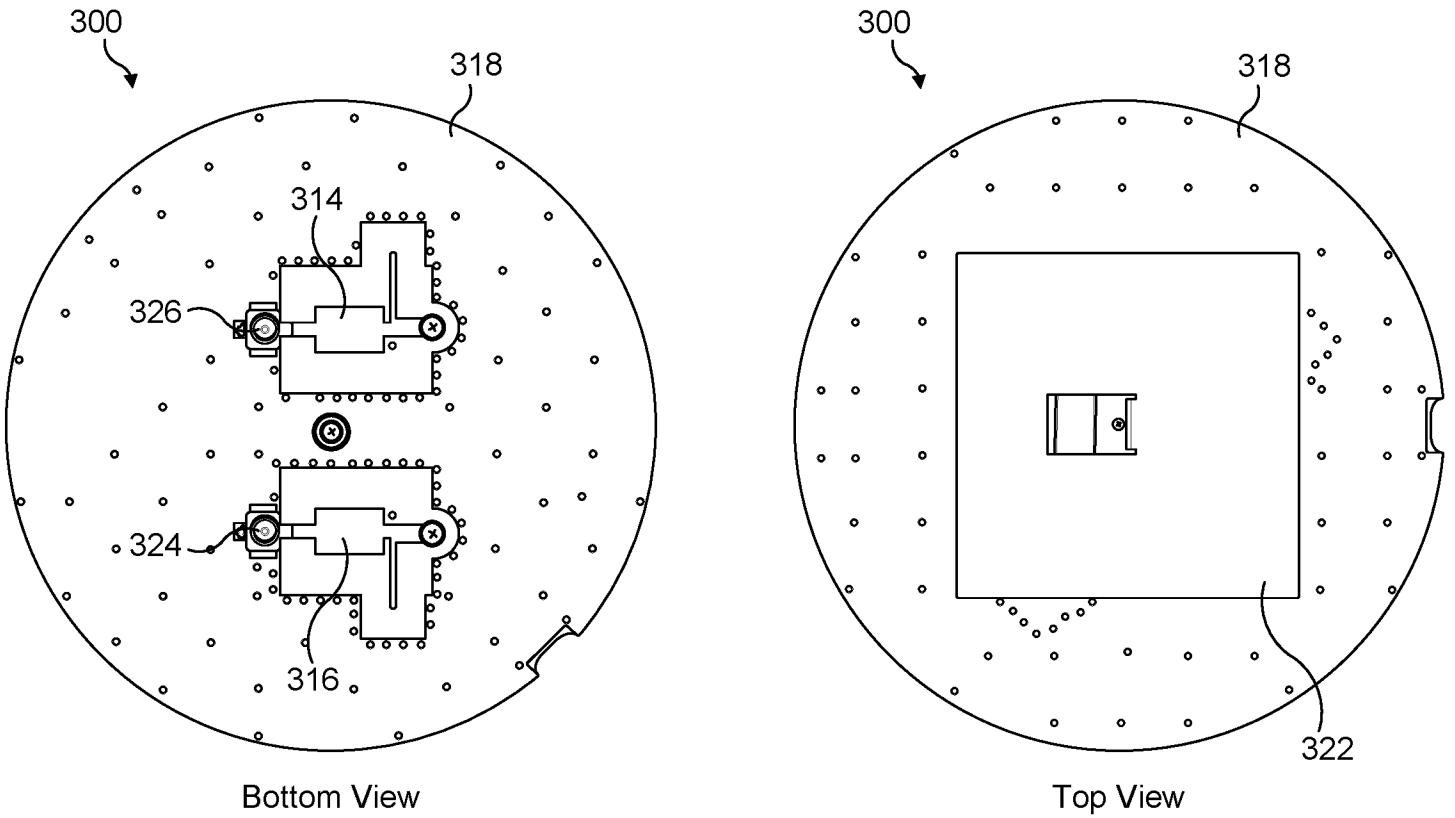
FIG. 3C illustrates the bottom and top view of an exemplary patch antenna structure.

FIG. 3C is a bottom view 350 and a top view 360 of an exemplary patch antenna. The ends 310 and 312 of conductive cables 302 and 304 respectively may be connected to microstrips 314 and 316 at connection points 324 and 326 respectively.

Figure 4A:
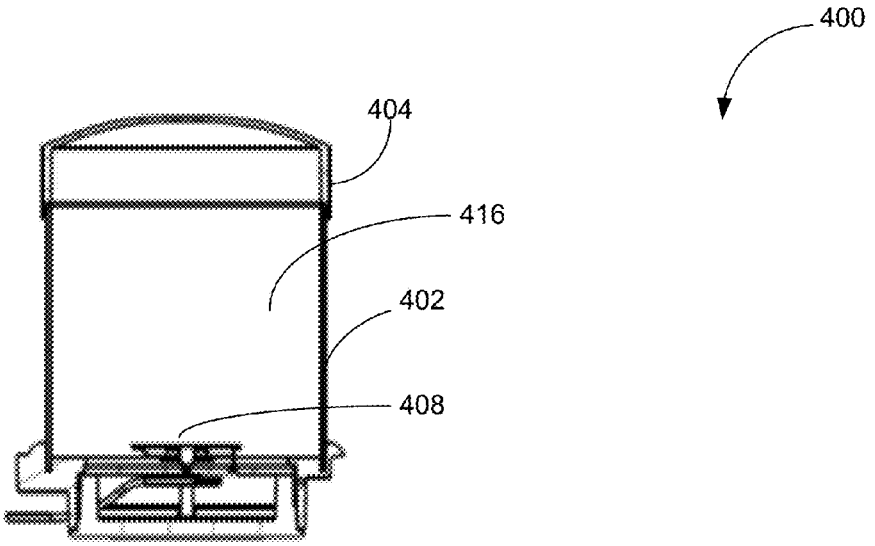
FIG. 4A illustrates a cross-sectional view of an exemplary center feed assembly suitable for receiving the exemplary patch antenna structure of FIG. 3C.
Figure 4B:
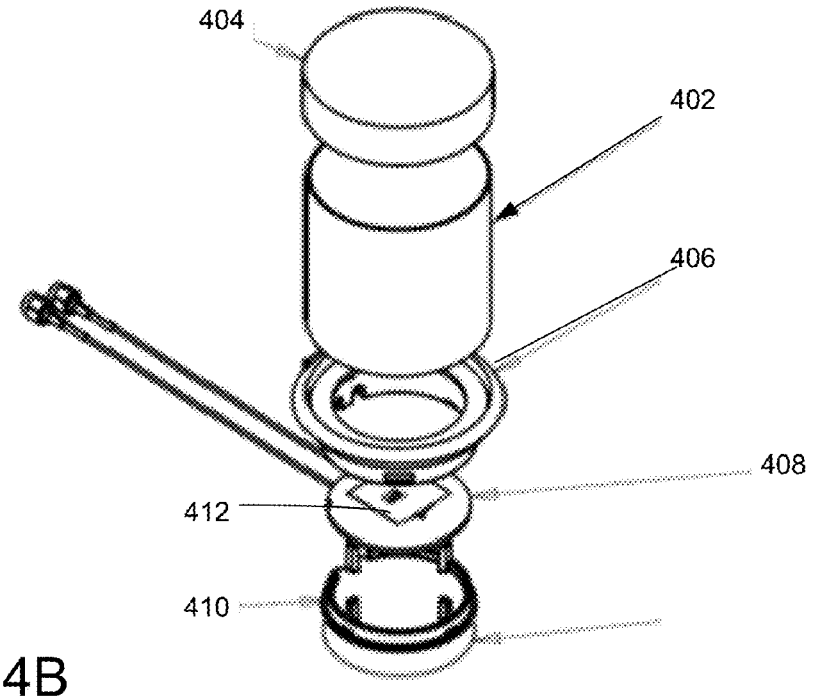
FIG. 4B illustrates an orthogonal view of the disassembled center feed assembly of FIG. 4A.

FIG. 4A is a cross-sectional view of a center feed assembly 400 and FIG. 4B is an orthogonal exploded view of the center feed assembly 400. In an embodiment, center feed assembly 400 may constitute a portion of antenna system 228. In an embodiment, elements that comprise the center feed assembly 300 include a hollow circular feed cylinder 402, a feed cylinder cover 404, base support 406, patch antenna assembly 408, and cable cover 410. The characteristics of these elements, separately and in the combination with center feed assembly 400, may improve the gain, efficiency and the bandwidth of an exemplary patch antenna. Patch antenna 408 may correspond to differential patch antenna assembly 300 (FIG. 3). The hollow circular feed cylinder 402 acts as a circular waveguide and the feed cylinder cover 404 operates as a lens for RF energy in the vicinity of the patch antenna assembly 408.

In an embodiment, exciting the patch antenna assembly 408 with RF signals generated by device 200 causes the radiating surface 412 of patch antenna assembly 408 to radiate energy into the cavity 416 of the hollow circular feed cylinder 402. The energy exiting the cavity 416 is dispersed by the feed cylinder cover 404.

Figure 5:
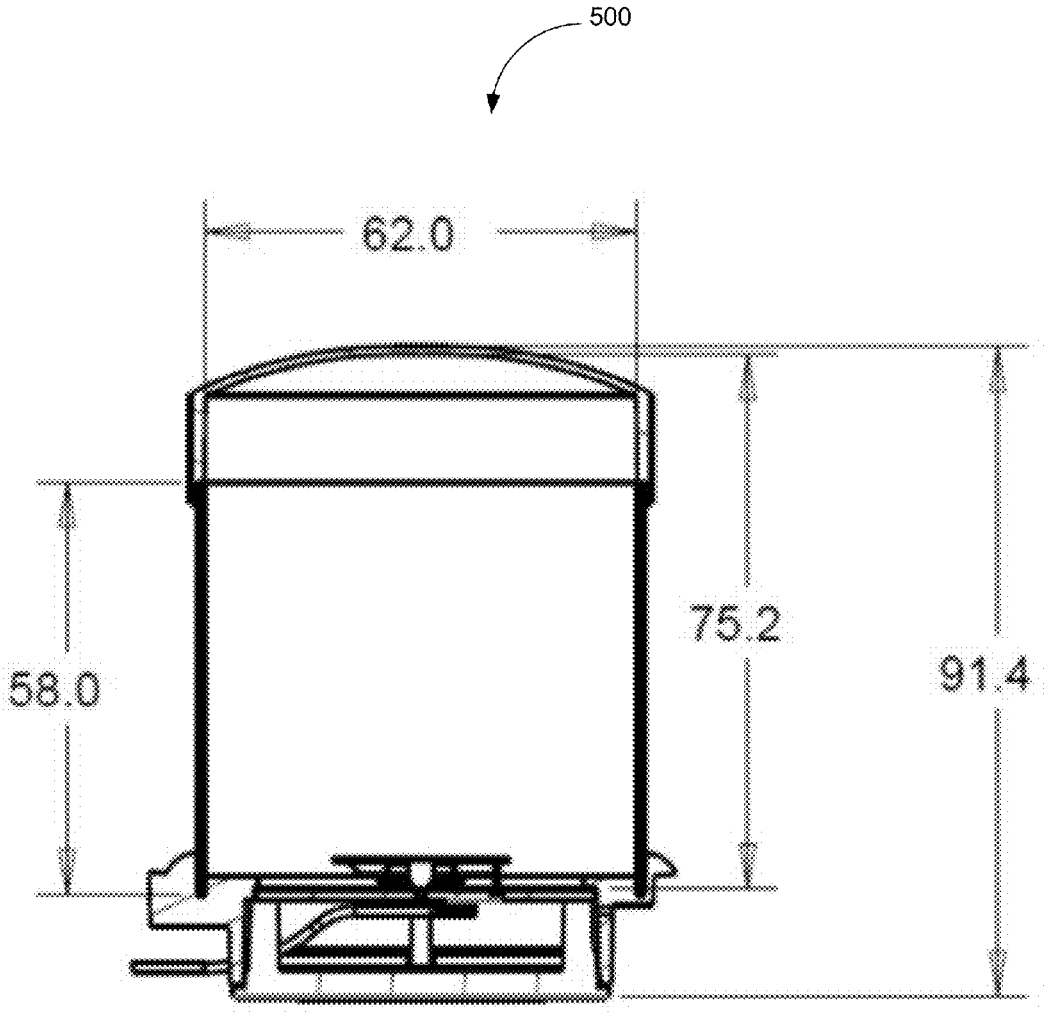
FIG. 5 illustrates the dimensions of an exemplary waveguide-lens combination for use with an exemplary center feed assembly.

FIG. 5 illustrates an exemplary waveguide-lens combination 500 that may be used with a differential patch antenna assembly 300, FIG. 3, for example. The waveguide-lens combination 500 may correspond to hollow circular feed cylinder 402 and feed cylinder cover 404. Dimensions in millimeters (mm) for an exemplary waveguide-lens combination 500 are depicted in FIG. 5. In an embodiment, an antenna system comprising a center feed assembly 400 that includes waveguide-lens combination 500 may be used with a patch antenna adapted to receive and radiate energy from RF signals with frequencies that range from 5.7 GHz to 5.9 GHz. The resulting antenna system may be capable of receiving and radiating energy from RF signals with frequencies that range from 5.2 GHz to 5.9 GHz.

Figure 6:
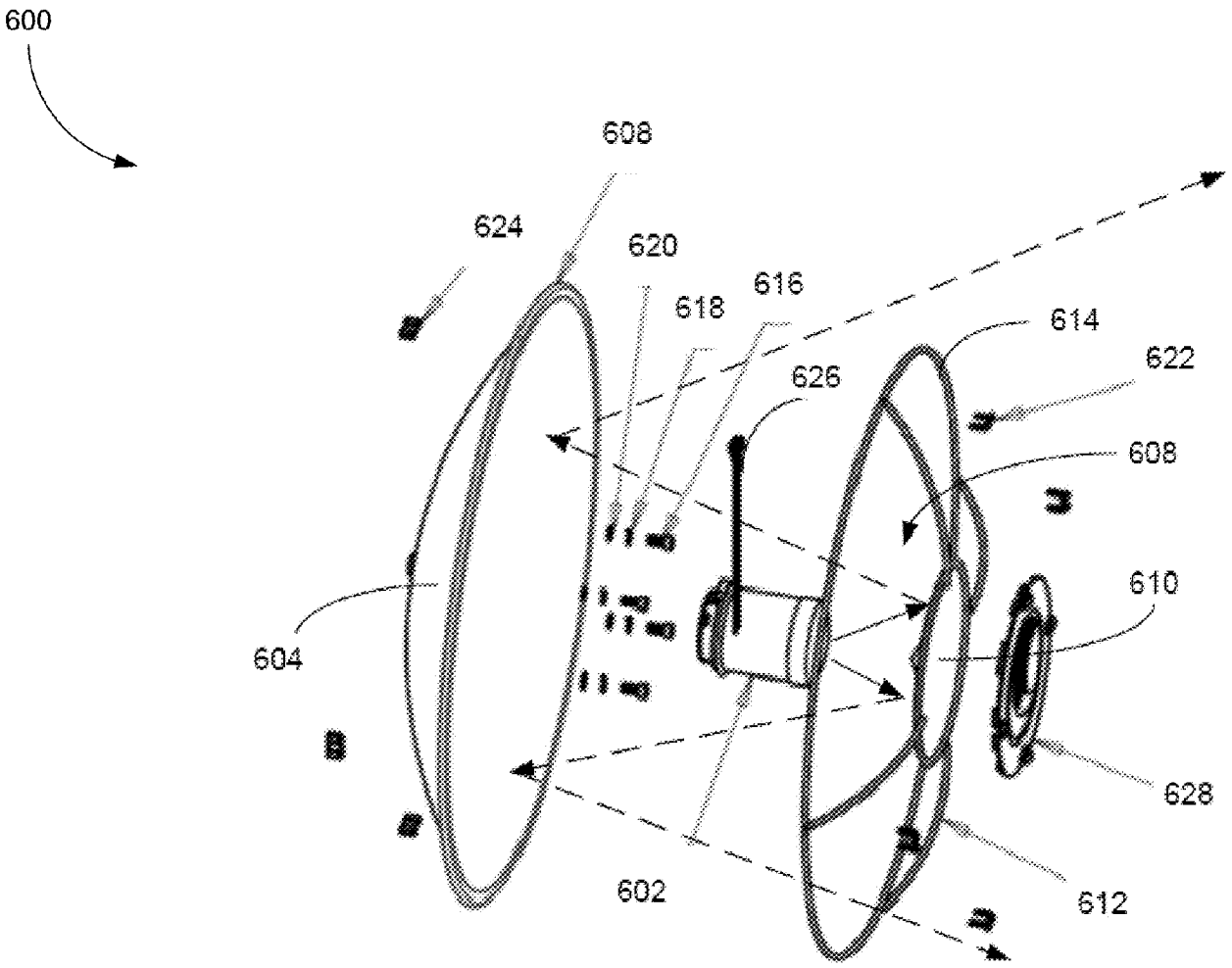
FIG. 6 illustrates an exemplary antenna system suitable for use with a wireless communication device.

FIG. 6 illustrates an exploded view of an exemplary antenna system 600. In an embodiment, antenna system 600 may correspond to antenna system 218 of FIG. 2. The exemplary antenna system comprises a center feed assembly 602, a parabolic dish antenna 604 and a secondary reflector 606. In an embodiment, the center feed assembly 602 may correspond to the center feed assembly 400. In a preferred embodiment, the hollow circular feed cylinder 402 and feed cylinder cover 404 of center feed assembly 400 may correspond to the waveguide-lens combination 500. Furthermore, the center feed assembly 602 may include the differential patch antenna assembly 300.

Parabolic dish antenna 604 is an antenna that uses a parabolic reflector to disperse energy. The parabolic reflector is characterized by a curved surface with a cross-sectional shape of a parabola. The circumferential edge 608 of the parabolic dish antenna may be folded over to form an edge with a circular profile. An exemplary parabolic dish antenna is available from Precise Plastic Co., Ltd.

The secondary reflector 606 comprises a face plate 610, curvilinear metal legs 612 and a base ring 614. The face plate 610, curvilinear metal legs 612 and base ring 614 form a hemispherical shape. In a preferred embodiment, the face plate is not coplanar but inverse tapered to point into the interior of the volume bounded by the imaginary surface of the hemispherical shape.

The face plate 610, metal legs 612 and base ring 614 may be constructed of a suitable metal and coated with a non-conductive paint. The curvilinear metal legs 612 may be soldered or welded to contact points on the circumference of the face plate 610. The other ends of the curvilinear metal legs 612 may be soldered or welded to contact points on the base ring 614. By way of example and without limitation, the contact point between a curvilinear metal leg 612 and the circumference of the face plate 610 is located equidistant from an adjacent contact point between another one of the curvilinear metal legs 312 and the circumference of the face plate 610.

The parabolic dish antenna 604 may be fastened to a support structure (not shown). The support structure may also support the device 200. In an embodiment, a set comprising a screw 616, a split lock washer 618 and a washer 620 may be used to fasten the base of the parabolic dish antenna 604 to the support structure. The support structure may be provided with threaded holes. Screw 616 may be screwed into one of the threaded holes. In a preferred embodiment, by way of example and without limitation, three such sets may be used to fasten the base of the parabolic dish antenna 604 to a support structure.

The circumference of base ring 614 of the secondary reflector 606 may be aligned with the circumferential edge 608 and fastened using a retainer clip 622 and a retainer clip cover 624. Several sets of retainer clips and corresponding retainer clip covers may be used to fasten the circumference of base ring 614 of the secondary reflector 606 with the circumferential edge 608.

The conductive cables 626 of differential patch antenna assembly 300 may be coupled to an output of device 200. RF signals generated by the device 200 may be coupled to the differential patch antenna assembly 300 via conductive cables 626. As previously discussed, the radiating surface of differential patch antenna assembly 300 may radiate energy at frequencies corresponding to the frequencies of the RF signals generated by device 200. The energy may be radiated into hollow circular feed cylinder 402 of center feed assembly 602. The feed cylinder cover 404 operating as a lens may direct the radiated energy towards the face plate 610 of the secondary reflector 606 as indicated by the direction of the arrows. The face plate 610 may reflect the energy towards the inner surface of the parabolic dish antenna 604. The energy may then be reflected away from the parabolic dish antenna 604 as indicated by the direction of the arrow head.

Figure 7:
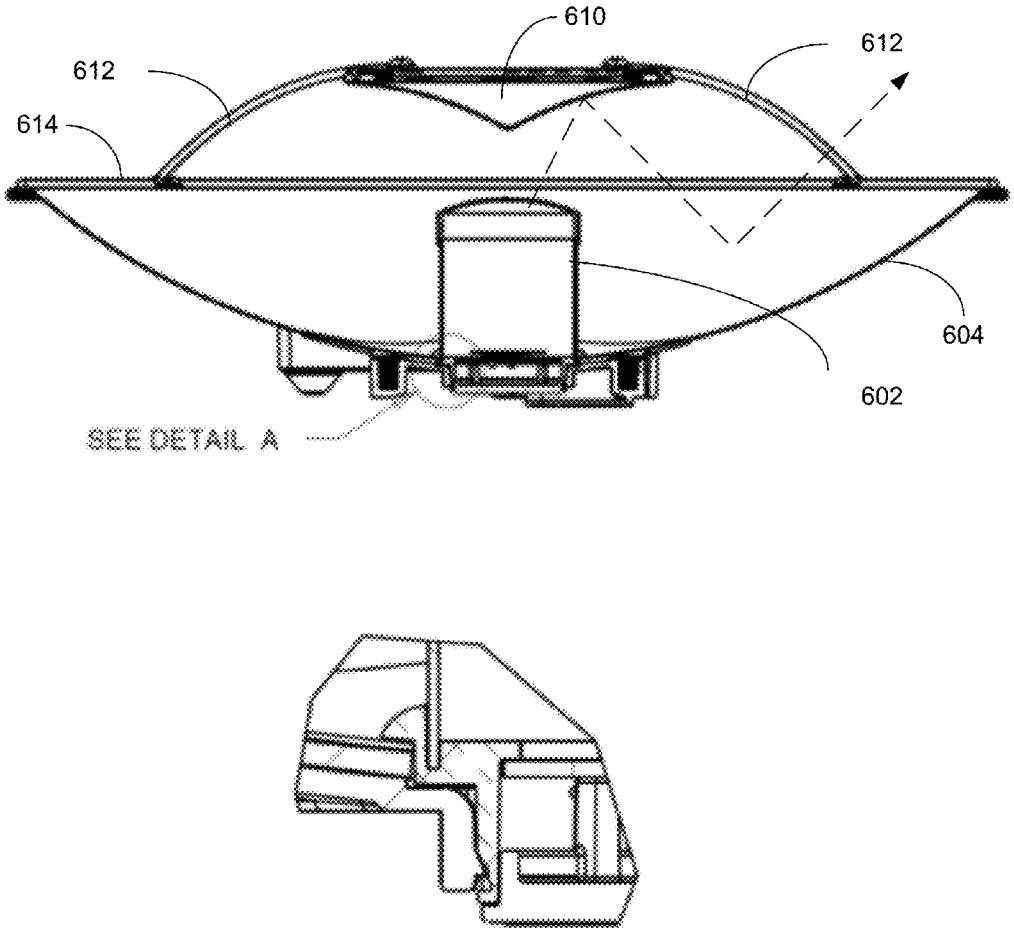
FIG. 7 illustrates a cross-sectional view of an exemplary antenna system.
Figure 8A:
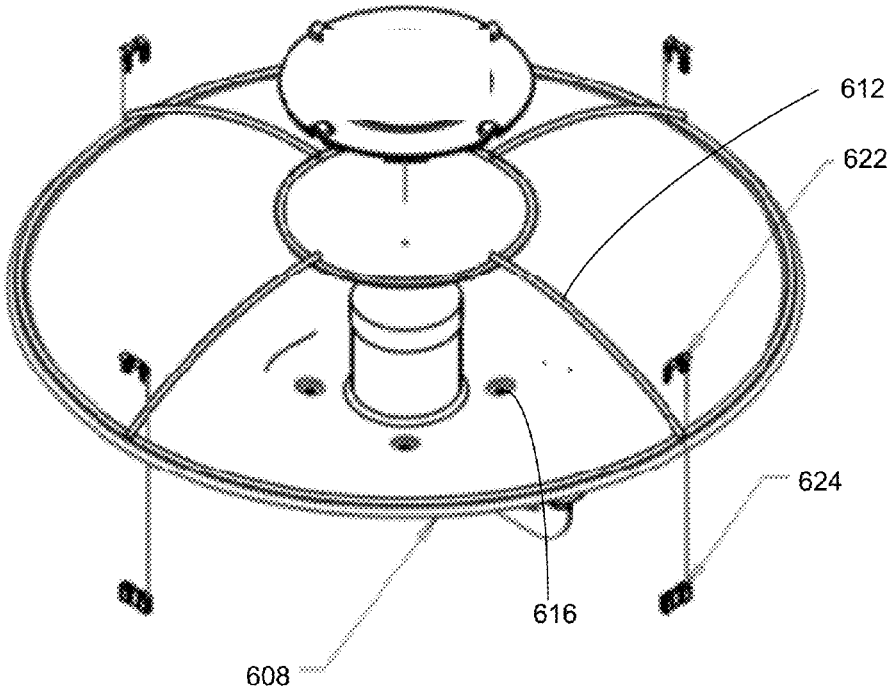
FIGS. 8A and 8B are perspective views of an exemplary antenna system.
Figure 8B:
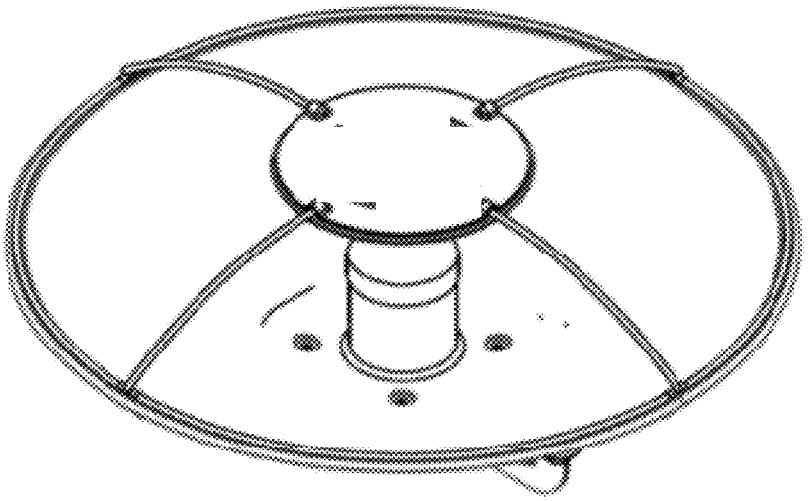

FIG. 7 is a cross-sectional view 700 of the assembled antenna system 600 illustrated in FIG. 6. FIGS. 8A and 8B are perspective view of the antenna system 600 illustrated in FIG. 6. Illustrated in FIG. 8A are four retainer clips 622 and retainer clip covers 624 that may be used to attach the circumference of base ring 614 of secondary reflector 606 to the circumferential edge 608 of parabolic dish antenna 604. FIG. 8B illustrates an assembled antenna system 600.

FIG. 9 illustrates an exemplary retainer clip 622 and retainer clip cover 624. In an embodiment, retainer clip 622 may be constructed out of a metal such as steel coated with a corrosion-resistant coating or stainless steel. Retainer clip 622 comprises a pair of curved members 902 and 904. The curvature of the curved members 902 and 904 may be selected so as to ensure maximal contact with the base ring 614 when the retainer clip engages the base ring 614.

The retainer clip 622 also comprises a pair of legs 906 and 908. Each leg may be provided with a tab 910 and 912. The width of the legs may correspond to the width of openings cut into circumferential edge 608 of parabolic dish antenna 604 so that the legs may engage the circumferential edge of the parabolic dish antenna. The tabs 910 and 912 may form respective angles with legs 906 and 908. The tab may be constructed such that when pressure is applied to the free end 916, for example, of the tab 912, in the direction of the leg 908, the tab 912 may flex downwards towards leg 908. When the pressure is removed the tab 912 may return to its original position. The parabolic dish antenna 604 may be provided with slits or cutouts along the circumferential edge 608. The legs and the tabs may be passed through these slits when using the retainer clip 622 and retainer clip cover 624

The retainer clip cover 624, in an exemplary embodiment, may be constructed of a non-conductive material. The retainer clip 624 is provided with two cavities 918 and 920. A cavity is dimensioned so as to accommodate a leg and a corresponding tab of the retainer clip 622. Each cavity may be provided with a respective notch 922 and 924. A width of the notch 922 may correspond to a width of a tab. The notch 922 serves as a guide for the tab 912. The legs and the tabs may be passed through these slits when using the retainer clip 622 and retainer clip cover 624 to hold the base ring 614 and the circumferential edge 608 together.

Figure 10:
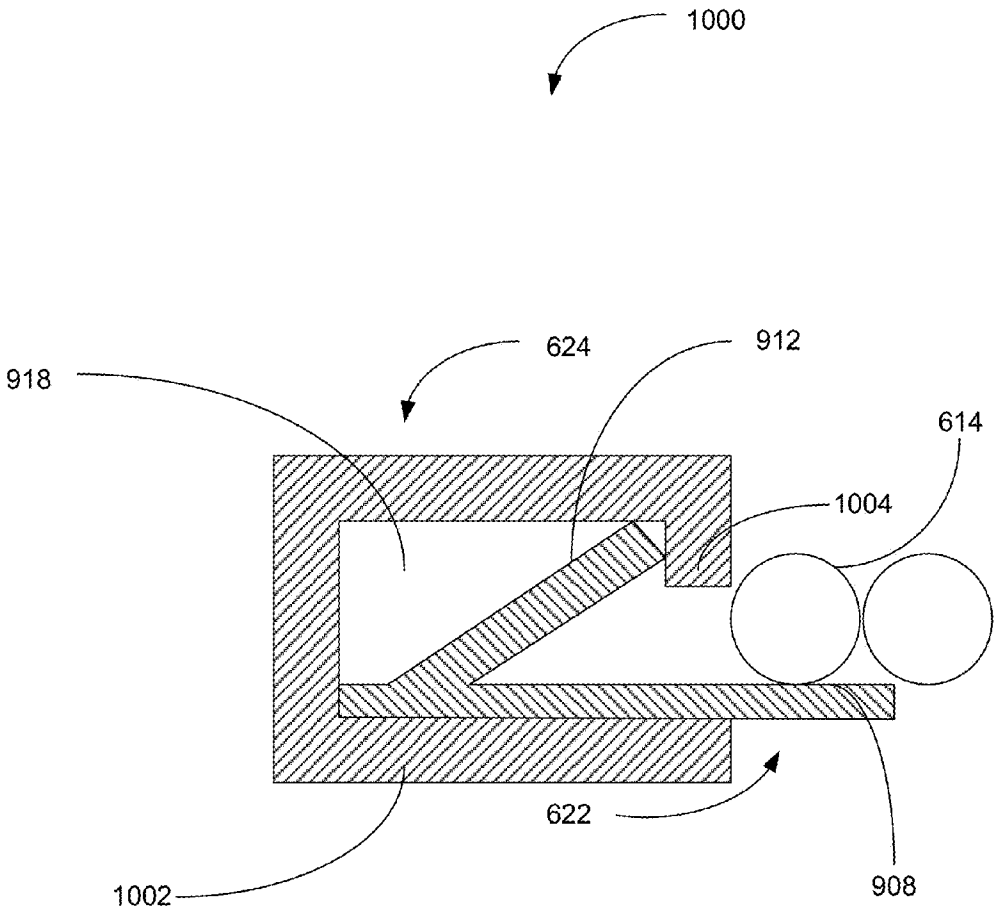
FIG. 10 illustrates a cross-sectional view of an exemplary retainer clip mated with an exemplary clip cover.

FIG. 10 illustrates a cross sectional view 1000 of a retainer clip 622 mated with a retainer clip cover 624. The body 1002 of retainer clip cover 624 is provided with an overhang 1004. When the leg 908 of retainer clip 622 is forced into the cavity 918 of retainer clip cover 624, the upper surface of the tab 912 contacts an edge of the overhang 1004. As the leg 908 is advanced into the cavity 918, the overhang 1004 applies a downward force to the tab 912 causing it to flex downwards towards the leg 908. Once the free end 916 advances past the overhang 1004, it snaps back to its original state and is locked in place behind the overhang 1004. In this state, the circumferential edge 608 of the parabolic dish antenna 604 may be forced against the body of retainer clip cover 624 by the base ring 614 of the secondary reflector 606. The base ring 614 may be forced towards the circumferential edge 608 of the parabolic dish antenna 604 by curved member 902.

Figure 11:
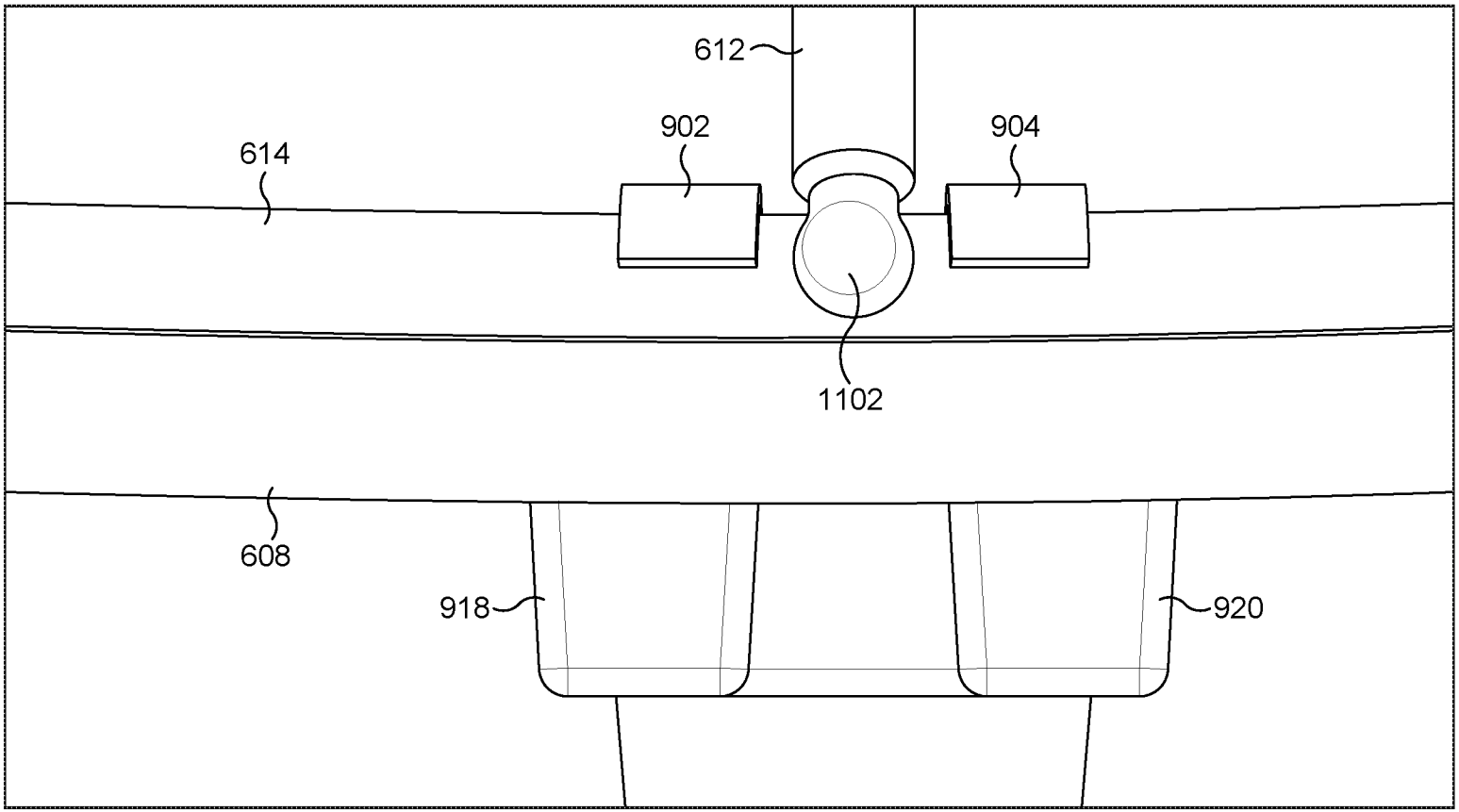
FIG. 11 illustrates a retainer clip mated with a retainer clip cover.

FIG. 11 illustrates a retainer clip 622 mated with a retainer clip cover 624 wherein the curved members 902 and 904 of retainer clip 622 and the retainer clip cover 624 clamp the base ring 614 and circumferential edge 608 of parabolic dish antenna respectively together. The tabs 910 and 912 and the legs of 906 and 908 of retainer clip 622 are slid into the cavities 918 and 920 of retainer clip cover 624 through slits provided along the circumferential edge 608. As previously discussed, the tabs 910 and 912 exert an outwards force on a respective interior wall of the cavities. This outward force locks the retainer clip cover 624 and retainer clip 622 in place. Typically, the contact point 1102 of a leg 612 and base ring 614 of secondary reflector 604 may be aligned between two slits provided along the circumferential edge 608. The legs 906 and 908 of retainer clip 622 may be slid through these slits. The cavities 918 and 920 of retainer clip cover 624 may be aligned under the circumferential edge 608 to receive the tabs 910 and 912 and the legs of 906 and 908.

Figure 12:
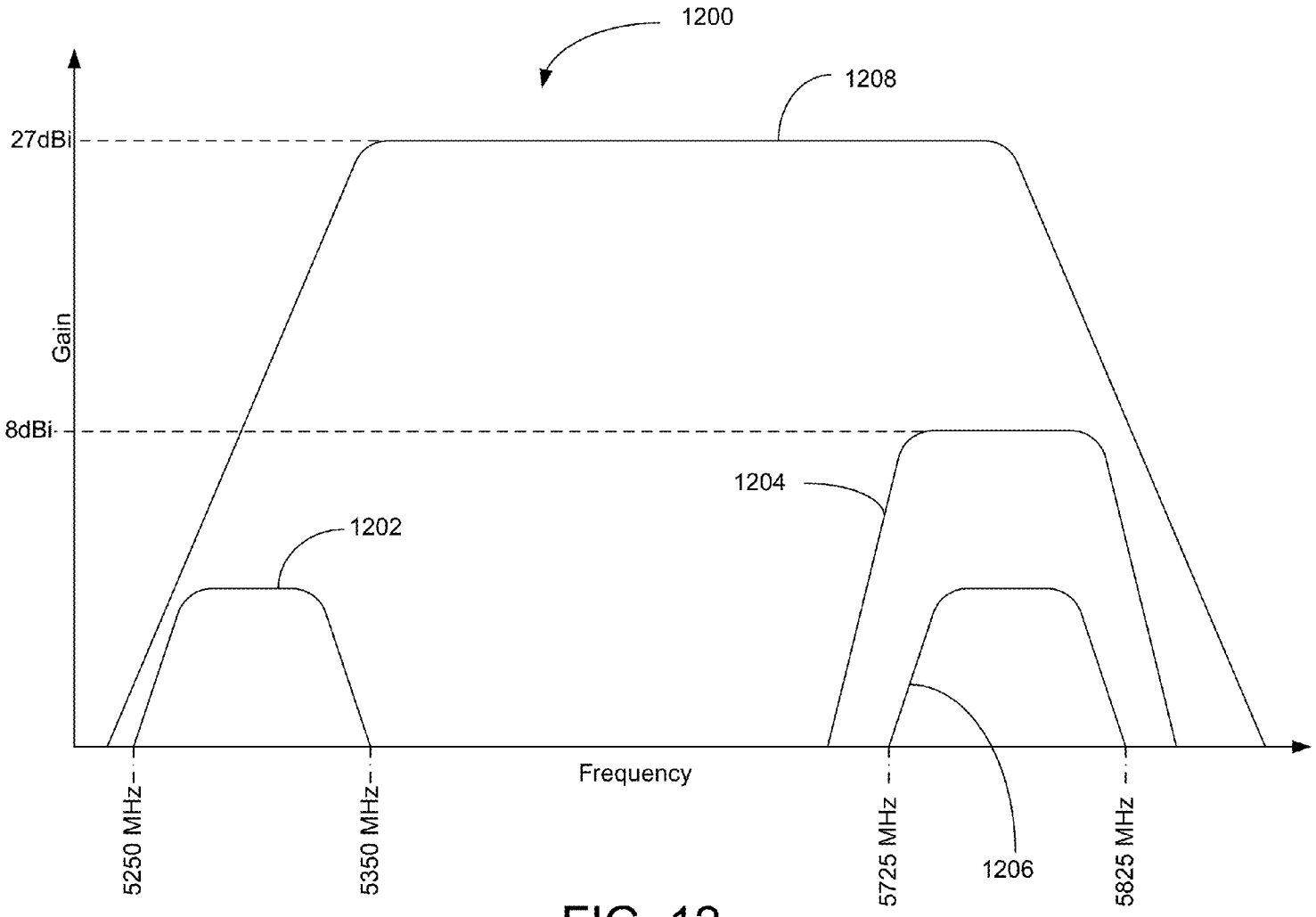
FIG. 12 illustrates the frequency response of several elements of an exemplary wireless device and elements of an exemplary antenna system.

FIG. 12 illustrates the comparative gain versus frequency response envelopes 1202, 1204, 1206 and 1208 for several exemplary wireless devices and elements of an exemplary antenna system for use with such wireless devices, in an embodiment. Frequency of RF signals is plotted along the X-axis and gain is plotted along the Y-axis. The height of the envelopes 1202, 1204, 1206 and 1208 represents the gain provided for the corresponding RF signal.

Frequency envelope 1202 represents RF signals having respective frequencies between 5250 MHz and 5350 MHz. The RF signals may be generated by device 200 and may encode data to be transmitted via wireless communication channel 114, for example. The difference between 5250 MHz and 5350 MHz may comprise the bandwidth of the device 200. Similarly, frequency envelope 1204 represents RF signals having respective frequencies between 5725 MHz and 5825 MHz. The RF signals may be generated by another exemplary device and may encode data to be transmitted via wireless communication channel 114, for example.

Frequency envelope 1206 represents the frequency response of an exemplary patch antenna, in accordance with one embodiment. The patch antenna provides a gain of 8 dBi to RF signals having frequencies that range from 5725 MHz and 5825 MHz. However, in this embodiment, the patch antenna attenuates frequencies outside this range. Thus RF signals produced by a wireless device characterized by a frequency envelope 1202 will not be transmitted by the patch antenna.

Frequency envelope 1208 represents the frequency response of an exemplary antenna system. In an embodiment, the exemplary antenna system may correspond to the antenna system 600 (FIG. 6). The antenna system may include the center feed assembly that include a waveguide-lens combination 500 and patch antenna assembly 300. The patch antenna assembly may include a patch antenna with a frequency response envelope 1206. The antenna system provides a gain of approximately 28 dBi to RF signals with frequencies that range from 5250 MHz to 5825 MHz. Thus, the antenna system provides increased the gain over a wider range of frequency.

From the foregoing, it can be seen that the present disclosure provides an antenna system having improved mechanical and electrical characteristics and performance. The antenna system may include a center feed assembly with a patch antenna assembly configured to radiate RF signals into a cavity of the center feed assembly. The center feed assembly is disposed within the dish antenna and may be configured to guide radiated energy onto the inverse tapered face plate of the secondary reflector. The antenna system can be manufactured with relatively inexpensive components including retainer clips and mating retainer clip covers to secure components of the antenna assembly. Many of the components of the antenna system may be purchased from conventional suppliers and need not be custom produced. This reduces the cost of the antenna system and simplifies deployment of the antenna system and a wireless communication system incorporating the antenna system. Such systems maybe located even in remote or difficult to reach locations and rapidly assembled without custom tooling or other equipment.

The specification and drawings are, accordingly, to be regarded as being illustrative rather than restrictive. It will, however, be evident that various modifications and changes may be made thereunto without departing from the broader spirit and scope of the invention as set forth in the claims.

We claim:

1. An antenna system comprising:

a center feed assembly having a waveguide and a lens;

a patch antenna arranged to transmit radio frequency (RF) signals from a first range of frequencies at a first gain and to transmit RF signals from a second range of frequencies at a second gain, wherein the second gain is less than the first gain and wherein the patch antenna is arranged to transmit the RF signals into the center feed assembly;

the center feed assembly being configured to cause the RF signals from the second range of frequencies to be transmitted with a gain greater than the second gain via the lens; and a primary dish and a secondary reflector, wherein the center feed assembly is configured to guide the transmitted signals towards a face of the secondary reflector and wherein the secondary reflector has an inverse tapered face plate;

wherein the patch antenna is configured to radiate the RF signals into a cavity of the center feed assembly, the center feed assembly being disposed within the primary dish, and wherein the center feed assembly is configured to guide radiated energy onto the inverse tapered face plate of the secondary reflector; and wherein the secondary reflector comprises a plurality of legs, wherein a first end of one of the plurality of legs is attached with an edge of the inverse tapered face plate and a second end of the one of the plurality of legs is attached to a base ring wherein a circumference of the base ring is similar to a circumference of the primary dish.

2. The antenna system of claim 1 wherein the base ring of the secondary reflector is attached to the circumference of the primary dish by a plurality of retainer clips and retainer clip covers.

3. The antenna system of claim 2 wherein each retainer clip comprises two curved members spaced apart from each other to accommodate the one of the plurality of legs and wherein each of the two curved members are adapted to contact a surface of the base ring.

4. The antenna system of claim 3 wherein each retainer clip further comprises two legs spaced apart from each other and wherein each of the legs is provided with a tab.

5. The antenna system of claim 4 wherein each retainer clip cover is provided with two cavities wherein each of the cavities is adapted to receive the respective leg and tab of the retainer clip.

* * * * *